United States Patent [19]

Urban

[11] Patent Number: 4,637,414

[45] Date of Patent: Jan. 20, 1987

[54] ARM PIECE ASSEMBLY FOR CRUTCH

[75] Inventor: Ted F. Urban, Oshkosh, Wis.

[73] Assignee: Lamico, Inc., Oshkosh, Wis.

[21] Appl. No.: 724,580

[22] Filed: Apr. 18, 1985

[51] Int. Cl.[4] ..... A61H 3/02

[52] U.S. Cl. ..... 135/73

[58] Field of Search ..... 135/73, 71, 72, 68, 135/69, 70

[56] References Cited

U.S. PATENT DOCUMENTS

| | | | |
|---|---|---|---|
| 1,241,815 | 10/1917 | Blackard | 135/68 |
| 2,362,642 | 11/1944 | Lamb | 135/73 |
| 2,417,171 | 3/1947 | McGowan | 135/73 |
| 2,442,896 | 6/1948 | Joseph | 135/73 |
| 2,856,943 | 10/1958 | Sparlin | 135/73 X |
| 3,150,672 | 9/1964 | Johnson, Jr. | 135/73 |
| 3,304,946 | 2/1967 | Lutes | 135/73 X |

FOREIGN PATENT DOCUMENTS

| | | | |
|---|---|---|---|
| 228387 | 12/1956 | Australia | 135/73 |
| 726468 | 1/1966 | Canada | 135/73 |

*Primary Examiner*—Robert A. Hafer
*Assistant Examiner*—Arnold W. Kramer
*Attorney, Agent, or Firm*—Andrus, Sceales, Starke & Sawall

[57] ABSTRACT

An improved arm piece assembly for a crutch, comprising an inner molded plastic arm piece and an outer removable elastomeric cover. The arm piece is formed with a pair of opposed side surfaces, a pair of end surfaces and a top surface that connects the side surfaces and end surfaces. One of the side surfaces is concave in a direction between the end surfaces to conform to the configuration of the rib cage of the user. A pair of tubular members or sockets are disposed on the interior of the arm piece and receive the bows of the crutch. Each end surface is provided with an opening and a fastening member, such as a screw, interconnects the bow with the respective socket and is disposed in alignment with the opening in the end surface. The elastomeric cover fits snugly over the arm piece and is provided with cushioning ribs on the inner surface which are disposed in engagement with the concave side surface of the arm piece.

13 Claims, 5 Drawing Figures

FIG. 1
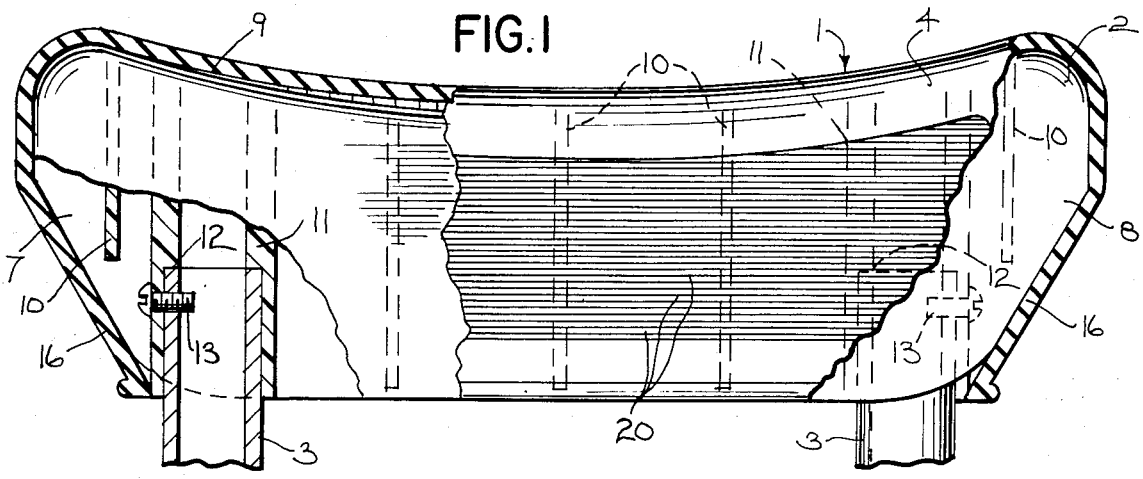
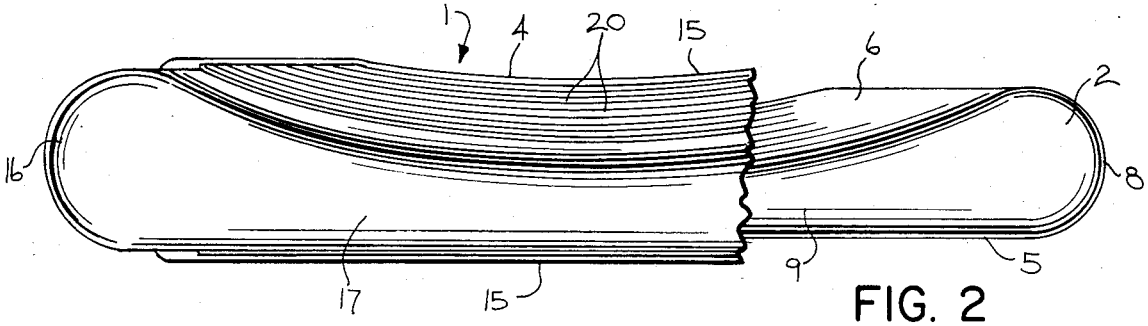
FIG. 2
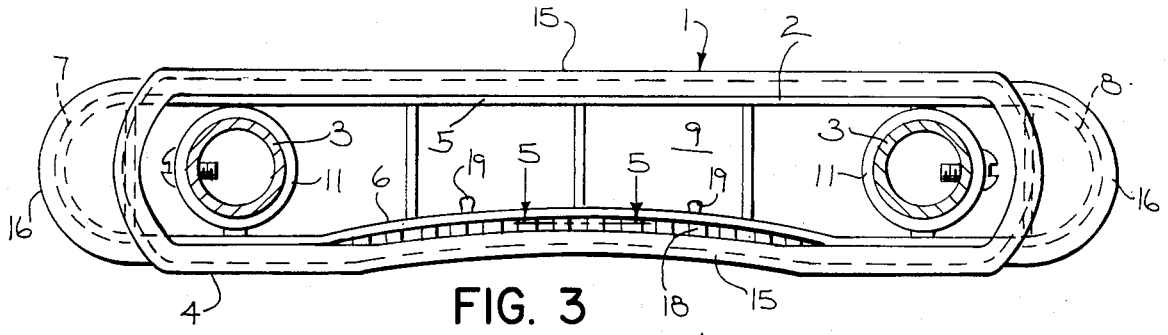
FIG. 3
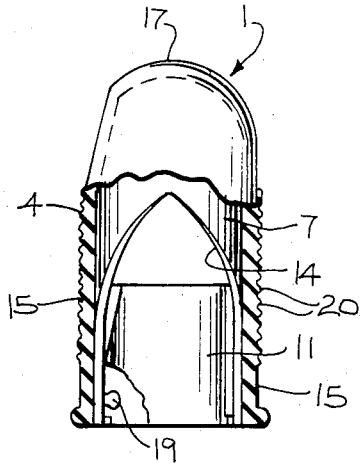
FIG. 4
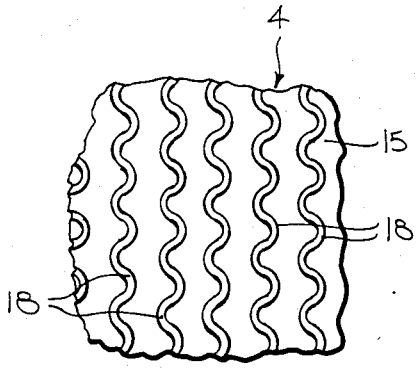
FIG. 5

ARM PIECE ASSEMBLY FOR CRUTCH

BACKGROUND OF THE INVENTION

In the past, an arm piece assembly of a crutch has been made of wood or molded plastic and covered with a foam rubber pad. Both opposed side surfaces of the arm piece are flat and lie in parallel planes.

In use, the flat side surface of the conventional arm piece bears against the curved rib cage of the user and even with the foam rubber pad, a pinch point is established between the flat side surface of the crutch and the rib cage, which makes the use of the crutch uncomfortable.

While the foam rubber pad, as used with the conventional arm piece assembly, is removable, the pad is difficult to clean, and as a consequence, often presents an unattractive appearance.

SUMMARY OF THE INVENTION

The invention is directed to an improved arm piece assembly for a crutch. In accordance with the invention the arm piece assembly includes an inner molded plastic arm piece and an outer elastomeric cover, which is slugly fitted over the arm piece.

The molded plastic arm piece has a pair of opposed side surfaces, a pair of end surfaces, and a top surface which connects the side surfaces and end surfaces. One of the side surfaces is concave in a direction extending between the end surfaces to conform generally to the contour of the rib cage of the user.

The interior of the arm piece is formed with a pair of tubular members or sockets which receive the upper ends of the bows of the crutch. Each end surface is provided with a recess or opening, and fasteners, such as screws, can be inserted through the openings to interconnect the sockets and the bows.

The inner surface of the elastomeric cover is provided with a plurality of cushioning ribs which are disposed in engagement with the concave side surface of the arm piece.

The concave side surface of the arm piece generally conforms to the contour of the rib cage of the user, so that the load is distributed to a greater area which results in improved comfort to the user.

The curved side surface of the arm piece also tends to prevent the arm piece from slipping out from under the arm in a forward or rear direction and thereby provides improved safety for use of the crutch.

The elastomeric pad with the cushioning ribs provides a less bulky pad than the conventional foam rubber pad and yet is easier to clean and maintain its appearance.

With the arm piece assembly of the invention, the bows can be readily removed from the arm piece for shipping or repair.

Other objects and advantages will appear in the course of the following description.

DESCRIPTION OF THE DRAWINGS

The drawings illustrate the best mode presently contemplated of carrying out the invention.

In the drawings:

FIG. 1 is a side elevation of the arm piece assembly of the invention with parts broken away in section;

FIG. 2 is a top view of the arm piece assembly with parts broken away;

FIG. 3 is a bottom view of the arm piece assembly;

FIG. 4 is an end view of the arm piece assembly with parts broken away; and

FIG. 5 is a section taken along line 5—5 of FIG. 3.

DESCRIPTION OF THE ILLUSTRATED EMBODIMENT

The drawings illustrate an arm piece assembly 1 for a crutch, which is composed of an inner molded plastic arm piece 2 which is removably connected to the bows 3 of a crutch and is covered by an elastomeric cover or pad 4.

The arm piece 2 includes a pair of opposed side surfaces 5 and 6, a pair of end surfaces 7 and 8, and a top surface 9 which interconnects the side surfaces and end surfaces. To provide added stiffness for the arm piece, a plurality of reinforcing ribs 10 extend vertically and interconnect the side surfaces 5 and 6.

As best shown in FIG. 1, top surface 9 is generally concave between the end surfaces 7 and 8, while end surfaces 7 and 8 are generally rounded and diverge downwardly, as shown in FIG. 1.

As illustrated in FIG. 2, side surface 5 is generally flat or planar, while the opposite side surface 6 is concave in a direction between end surfaces 7 and 8 and generally conforms to the rib cage of the user.

A pair of sockets or tubular members 11 are located on the interior of arm piece and receive the upper ends of bows 3 of the crutch. Shoulders 12 are spaced from the lower ends of the sockets 11 and serve as stops to limit the insertion of the bows 3 within the sockets 11. The bows are removably secured within sockets 11 by screws 13, or other fasteners.

As best illustrated in FIG. 4, the lower portion of each end surface 7 and 8 is provided with a recess or opening 14, which is aligned with the sockets 11 and provides access for insertion and removal of screws 13.

Cover 4 is formed of an elastomeric material and is adapted to be stretched over the arm piece 2 to snugly fit around the arm piece. Cover 4 is provided with a pair of sides 15, a pair of opposed ends 16 and a top 17 which connects the side and ends together.

To provide added cushioning for the rib cage of the user, the interior of one of the sides 15 is formed with a plurality of cushioning ribs 18. As illustrated in FIG. 5 the ribs have a generally sinusoidal configuration, but it is contemplated that various types of ribs, or projections of different configuration can be utilized. Cushioning ribs 18 bear against the concave side surface 6 of arm piece 2.

In order to maintain the side 15 of cover 4 in tight engagement with the curved surface 6 of arm piece 2 and prevent the cover from rolling up, a plurality of inwardly projecting ribs or projections 19 are formed on side 15 and are received in holes in surface 6. Projections 19 diverge outwardly to provide enlarged heads that are press-fitted into the holes in surface 6.

To prevent slippage of the arm piece assembly from the arm pit of the user, the outer surfaces of sides 15 of cover 4 can be provided with ribs or serrations 20.

As the curved side surface 6 of arm piece 2 generally conforms to the contour of the rib cage of the user, the load is distributed through a greater surface area which provides more comfort to the user.

The concave side surface 6 also prevents the arm piece assembly from slipping in a forward or rear direction during use and thereby provides improved safety for the crutch.

The elastomeric cover 4, in combination with the cushioning ribs 18, achieves more effective cushioning for the rib cage and yet provides a less bulky construction than a conventional arm piece assembly using a foam rubber pad.

Various modes of carrying out the invention are contemplated as being within the scope of the following claims particularly pointing out and distinctly claiming the subject matter which is regarded as the invention.

I claim:

1. An arm piece assembly for a crutch, comprising an arm piece having a pair of opposed side surfaces, a pair of end surfaces and a top surface interconnecting the side surfaces and the end surfaces, said top surface being generally concave in a direction between said end surfaces, one of said side surfaces being concave in a direction between said end surfaces and being inclined upwardly in a direction toward the other of said side surfaces, connecting means disposed on the interior of the arm piece to removably receive the bows of a crutch, each end surface having an opening therein, fastening means interconnecting the connecting means with the respective bow and disposed in alignment with said opening, and a removable elastomeric cover snugly fitting over said arm piece and enclosing said openings.

2. The arm piece assembly of claim 1, and including cushioning means disposed on the inner surface of said cover and disposed in engagement with said one surface of said arm piece.

3. The assembly of claim 2, wherein said cushioning means comprises a plurality of generally parallel ribs.

4. The assembly of claim 1, wherein said connecting means comprises a pair of spaced tubular members, each tubular member disposed to telescopically receive one of the bows of said crutch.

5. The assembly of claim 4, wherein said fastening means comprises a screw.

6. The assembly of claim 4, and including stop means associated with each tubular member to limit the insertion of the respective bow with said tubular member.

7. The assembly of claim 1, wherein said cover comprises a pair of sides, a pair of opposed ends, and a top interconnecting said side and ends, said cover having an open bottom.

8. The assembly of claim 1, wherein the other side surface is flat.

9. A crutch construction, comprising a crutch having a pair of generally parallel vertical bows, and an arm piece assembly connected to the upper ends of said bows, said arm piece assembly including a molded plastic arm piece having a pair of opposed side surfaces and a pair of opposed end surfaces and a top surface interconnecting said side surfaces and said end surfaces, said arm piece having an open bottom, one of said side surfaces being generally concave in a horizontal direction between said end surfaces to conform to the curvature of the rib cage of the user, a pair of connecting members disposed on the interior of the arm piece, the upper ends of said bows being telescopically connected to said connecting members, each end surface having an opening therein, fastening means aligned with each opening for interconnecting the connecting member and the respective bow, a removable elastomeric cover snugly fitting over said arm piece, and cushioning means on the inner surface of said cover and disposed in engagement with said one surface of said arm piece.

10. The crutch construction of claim 9, wherein each of said openings extends upwardly from the bottom edge of the respective end surface, said cover enclosing said openings.

11. The crutch construction of claim 9, wherein said cushioning means comprises a plurality of generally sinusoidal ribs.

12. The crutch construction of claim 9, wherein said cushioning means comprises a plurality of projections on the inner surface of said cover.

13. A crutch construction, comprising a crutch having a pair of generally parallel vertical bows, and an arm piece assembly connected to the upper ends of said bows, said armpiece assembly including an inner rigid arm piece having a pair of opposed side surfaces and a pair of opposed end surfaces and a top surface interconnecting said side surface and said end surfaces, said arm piece having an open bottom, one of said side surfaces being generally concave in a horizontal direction between said end surfaces and being inclined upwardly in a direction toward the other of said side surfaces, a pair of connecting members disposed on the interior of said arm piece, the upper ends of said bows being telescopically connected to said connecting members, each end surface having an opening therein, fastening means aligned with each opening for interconnecting the connecting member and the respective bow, and a removable elastomeric cover snugly fitting over said arm piece.

* * * * *